US006979802B2

(12) United States Patent
Struble et al.

(10) Patent No.: US 6,979,802 B2
(45) Date of Patent: Dec. 27, 2005

(54) APPARATUS AND METHOD FOR THERMALLY PROCESSING AN IMAGING MATERIAL EMPLOYING A PREHEAT CHAMBER

(75) Inventors: Kent R. Struble, Woodbury, MN (US); Duane A. Preszler, River Falls, WI (US)

(73) Assignee: Eastman Kodak Company, Rochester, NY (US)

( * ) Notice: Subject to any disclaimer, the term of this patent is extended or adjusted under 35 U.S.C. 154(b) by 61 days.

(21) Appl. No.: 10/815,027

(22) Filed: Mar. 31, 2004

(65) Prior Publication Data

US 2005/0218138 A1 Oct. 6, 2005

(51) Int. Cl.[7] ..... F27D 11/00
(52) U.S. Cl. ..... 219/388; 399/328; 432/60
(58) Field of Search 219/216, 469–471; 399/328–332, 399/335–338; 432/60, 228; 118/60

(56) References Cited

U.S. PATENT DOCUMENTS 4,198,145 A * 4/1980 Scott ..... 396/571
5,869,806 A 2/1999 Struble et al.
5,895,592 A * 4/1999 Struble et al. ..... 219/216

* cited by examiner

*Primary Examiner*—Thor S. Campbell
(74) *Attorney, Agent, or Firm*—Susan L. Parulski

(57) ABSTRACT

A preheat chamber for conditioning an imaging material having a conditioning threshold temperature and a developing threshold temperature. The preheat chamber includes a chamber housing and a heating system. The heating system is configured to heat imaging material to a desired conditioning temperature above the conditioning threshold temperature and below the developing threshold temperature as the imaging material is moved through the chamber housing.

44 Claims, 3 Drawing Sheets

APPARATUS AND METHOD FOR THERMALLY PROCESSING AN IMAGING MATERIAL EMPLOYING A PREHEAT CHAMBER

FIELD OF THE INVENTION

The present invention relates generally to an apparatus and method for processing an imaging material, and more specifically to an apparatus and method for thermally developing an imaging material employing a preheat chamber.

BACKGROUND OF THE INVENTION

Light sensitive photothermographic or heat sensitive film typically includes a thin polymer or paper base coated, generally on one side, with an emulsion of dry silver or other heat sensitive material. Such photothermographic film is normally processed or developed at a temperature generally in the vicinity of 120 degrees centigrade. To produce a high quality image, controlling heat transfer to the photothermographic film during the development process is critical. If heat transfer is not uniform during development, visual artifacts such as non-uniform density and streaking may occur. If heat is transferred too quickly, the base of some types of photothermographic film can expand too rapidly, resulting in expansion wrinkles that can cause visual artifacts in a developed image.

Several processing machines have been developed in efforts to achieve optimal heat transfer to the photothermographic film during processing. One employs a heated drum with multiple rollers around the exterior of the drum's circumference to press the film against the drum. This technique is typically best suited for film having an emulsion coating on only one side, as more heat is generally transferred to the side of the film facing the drum as compared to the side opposite the drum. Another machine slides the photothermographic film over flat heated surfaces in a horizontal path or over plates arranged in a circular path. Still another machine is a flat-path processor having rollers above and below the film to transport the film through the processor.

The processors in each of these machines heats the photothermographic film to a processing temperature and maintains the film at the processing temperature for a set time for optimal development. One processor includes a preheat zone that rapidly heats the film to the development temperature to initiate the development process, and a dwell zone that keeps the film at the development temperature for the set time to complete development.

While such processors are effective at developing photothermographic films prepared using polymeric binders coated from organic solvents, they are not as well-suited for processing newly emerging gelatin-based photothermographic films. These films are coated from aqueous-based solvents, contain heat sensitive materials such as developers, and require a higher development temperature. The moisture content of these aqueous-based emulsions can affect the heat transfer characteristics of the film and, consequently, the quality of images produced during processing. The moisture level of these emulsions is also susceptible to changes depending on the temperature and humidity of the environment in which they are stored and used. Consequently, the moisture level of the emulsion can vary between films. This can result in film-to-film variations in image quality after processing.

It is evident that there is a need for a photothermographic film processor capable of uniformly developing gelatin-based photothermographic film without introducing visual artifacts as described above.

SUMMARY OF THE INVENTION

In one embodiment, the present invention provides a preheat chamber for conditioning an imaging material having a conditioning threshold temperature and a developing threshold temperature. The preheat chamber includes a chamber housing and a heating system, the heating system is configured to heat the imaging material to a desired conditioning temperature above the conditioning threshold temperature and below the developing threshold temperature as the imaging material is moved through the chamber housing.

In one embodiment, the present invention provides a thermal processor for thermally developing an image in an imaging material having a conditioning threshold temperature and a developing threshold temperature. The thermal processor includes a preheat chamber and a dwell chamber. The preheat chamber is configured to receive the imaging material at an ambient temperature and to heat the imaging material to a desired conditioning temperature at least equal to the conditioning threshold temperature but less than the development threshold temperature. The dwell chamber is configured to receive the imaging material at the conditioning temperature and to heat the imaging material to a desired developing temperature at least equal to the developing threshold temperature.

In one embodiment, the imaging material includes an aqueous-based emulsion including heat sensitive materials and having a moisture level, wherein a temperature level at least equal to the conditioning threshold temperature causes moisture to be released from the aqueous-based emulsion, and a temperature level at least equal to the development temperature causes the image to develop. In one embodiment, the preheat chamber is configured to maintain the imaging material at the conditioning temperature for a time period necessary to cause substantially all of the moisture to be released from the emulsion.

By removing substantially all of the moisture from the aqueous-based emulsion of the imaging material prior to development, the present invention minimizes the potential of post-development visual artifacts due to excessive moisture levels and minimizes the potential for variations in image quality from film-to-film. Also, heating the imaging material to a desired conditioning temperature prior to heating the imaging material to a desired developing temperature reduces the potential of visual artifacts related to expansion of a base material of the imaging material.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION OF THE INVENTION

The invention has been described in detail with particular reference to certain preferred embodiments thereof, but it will be understood that variations and modifications can be effected within the spirit and scope of the invention.

Figure 1:
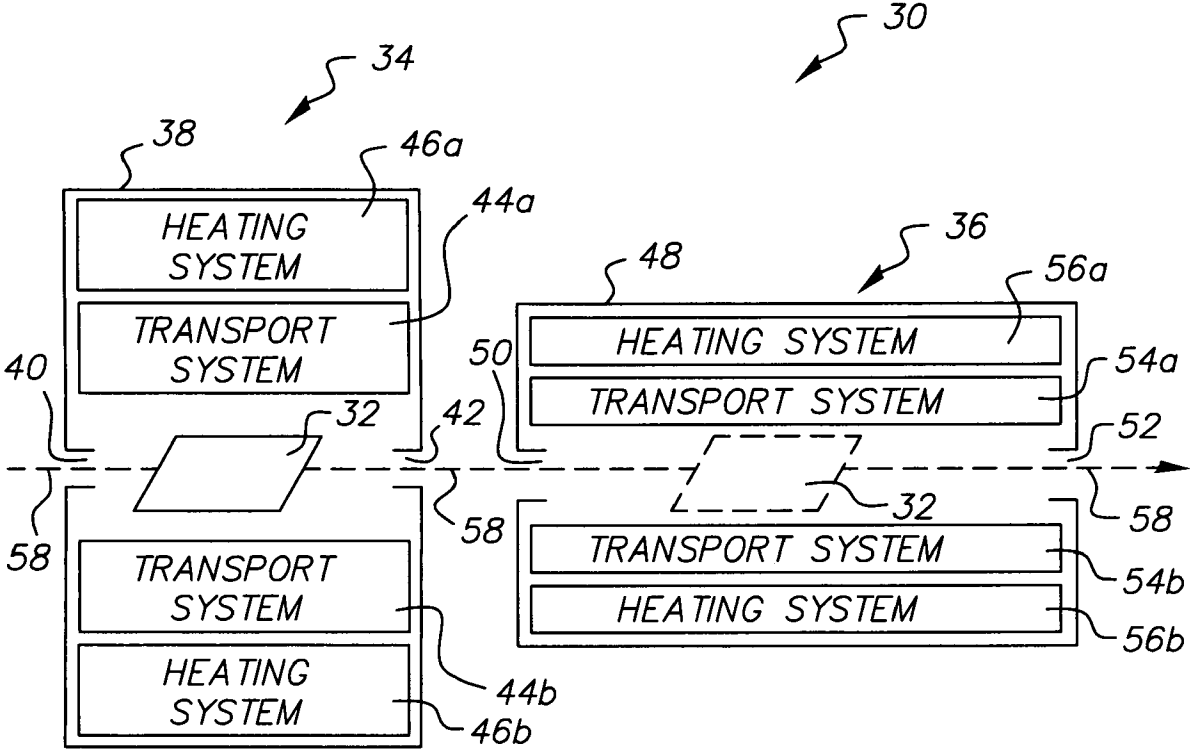
FIG. 1 is a block diagram illustrating one exemplary embodiment of a thermal processor according to the present invention.

FIG. 1 is a block diagram illustrating generally one embodiment of a thermal processor 30 in accordance with the present invention for developing an image in an imaging material 32 having a conditioning threshold temperature and a development threshold temperature.

An example of a thermally processable imaging material suitable for development by thermal processor 30 is the gelatin- or aqueous-based photothermographic imaging film disclosed in pending U.S. patent application Ser. No. 10/715,199, filed on Nov. 17, 2003, commonly assigned, and incorporated herein by reference.

One type of gelatin-based photothermographic imaging material suitable for development by thermal processor 30 comprises a base material coated on each side with an aqueous-based emulsion of heat sensitive materials, including developers, in an aqueous-based solvent. When heated to a temperature at or above a conditioning threshold temperature, fluid, consisting primarily of water, is released in vaporous form from the emulsion, leaving the heat sensitive materials on the imaging material. When subsequently heated to a temperature at or above a development threshold temperature, the heat sensitive materials react to form an image on the imaging material.

Thermal processor 30 includes a preheat chamber 34 and a dwell chamber 36 that is thermally isolated from preheat chamber 34. Preheat chamber 34 includes a housing 38, having an entrance 40 and an exit 42, enclosing a transport system 44 and a heating system 46. Dwell chamber 36 includes a housing 48, having an entrance 50 and an exit 52, enclosing a transport system 54 and a heating system 56.

Preheat chamber 34 receives imaging material 32 at an ambient temperature and with the emulsion having an arbitrary moisture level at entrance 40. Transport system 44 moves imaging material 32 through preheat chamber 34 along a transport path 58 from entrance 40 to exit 42. As imaging material 32 moves through preheat chamber 34, heating system 46 heats imaging material 32 to a desired conditioning temperature at least equal to the imaging material's preconditioning threshold temperature but less than the development threshold temperature.

In one embodiment, the desired conditioning temperature is within a conditioning temperature range. The low end of the range is at a margin above the conditioning threshold temperature, and the high end of the range is a margin below the development threshold temperature to ensure that desired conditioning temperature is high enough to cause the water/moisture to be released from the emulsion but low enough to prevent the heat sensitive developing compounds from reacting and developing the image. In one embodiment, the conditioning temperature is within a range from 110 to 130 degrees centigrade (° C.), with a desired conditioning temperature of 120° C.

As the temperature of imaging material 32 exceeds the conditioning threshold temperature and reaches the desired conditioning temperature, water begins to be released from the aqueous-based emulsion in the form of water vapor. Preheat chamber 34 maintains the imaging material at the conditioning temperature for a conditioning period at least long enough for substantially all of the water/moisture to be released from the emulsion. In one embodiment, the conditioning period is within a time range. In a preferred embodiment, preheat chamber 34 maintains imaging material 32 at a conditioning temperature of 120° C. for a conditioning period of 5 seconds.

In one embodiment, transport system 44 moves imaging material 32 through preheat chamber 34 at a rate such that imaging material 32 is maintained at the desired conditioning temperature for the conditioning period. In this embodiment, transport system 44 receives imaging material 32 at the ambient temperature at entrance 40, moves imaging material 32 along transport path 58, and provides imaging material 32 at exit 42 at substantially the conditioning temperature and with substantially all of the water/moisture released from the emulsion. In one embodiment, transport system 44 moves imaging material 32 through preheat chamber 34 at a rate within a range of 0.4-to-0.5 inches per second. It is noted, however, that the rate at which transport system 44 moves imaging material 32 is dependent on the conditioning period and a length of preheat chamber 34.

Dwell chamber 36 receives imaging material 32 from preheat chamber 34 at entrance 50, with imaging material 32 at a temperature substantially equal to the conditioning temperature and with substantially all of the water/moisture released from the emulsion. Transport system 54 moves imaging material 32 through dwell chamber 36 along transport path 58 in proximity to heating system 56 from entrance 50 to exit 52.

As imaging material 32 through dwell chamber 36, heating system 56 heats imaging material 32 from the preconditioning temperature to a development temperature at least equal to the development threshold temperature. In one embodiment, the development temperature is within a development temperature range. In one embodiment, the development temperature range is from 135° C. to 165° C., and in a preferred embodiment the development temperature is 150° C.

Dwell chamber 36 maintains imaging material 32 at the development temperature for a development period that will provide substantially optimal development of the image in imaging material 32. In one embodiment, the development period is within a time range. In one embodiment, the development period ranges from 18 to 25 seconds. In a preferred embodiment, dwell chamber 36 maintains imaging material 32 at a development temperature of 150° C. for a development period of 20 seconds.

In one embodiment, transport system 54 moves imaging material 32 through dwell chamber 36 at a rate such that imaging material 32 is maintained at the desired conditioning temperature for conditioning period. In this embodiment, transport system 44 receives imaging material 32 at the ambient temperature at entrance 40, moves imaging material 32 along transport path 58, and provides imaging material 32 at exit 42 at substantially the conditioning temperature and with substantially all of the water/moisture released from the emulsion.

One characteristic of gelatin-based photothermographic imaging material is that the moisture level, or the amount of water, in the aqueous-based emulsion can change depending on the film's local operating environment, with humidity being the primary factor. Essentially, the aqueous-based emulsion is somewhat sponge-like and can absorb water from the surrounding air. Because humidity varies from location to location and can vary over time at a given location, the moisture level of the emulsion can vary from film to film at the time of development. Furthermore, since the amount of water in the aqueous-based emulsion affects the film's heat transfer characteristics (i.e., the more water the more heat that must be transferred to heat the film to a desired temperature), the varying moisture levels can potentially result in undesirable variations in image quality from film-to-film. For example, excessive moisture levels can result in streaking or variations in development density of developed images.

By substantially removing all of the moisture from the aqueous-based emulsion of imaging material 32 at preheat chamber 34 prior to providing imaging material 32 to dwell chamber 36 for development, thermal processor 30 minimizes the potential of visual artifacts due to excessive moisture levels and minimizes the potential for variations in image quality from film to film. Furthermore, by heating imaging material 32 to the conditioning temperature prior to its entering dwell chamber 36, dwell chamber 36 needs to raise the temperature of imaging material 32 to the developing temperature from the conditioning temperature rather than the ambient temperature, thereby reducing visual artifacts caused by expansion of the base material.

When rollers and heat plates are spaced along a horizontal transport path, a thermal processor can be referred to as a flatbed-type processor. (For example, as further described below with reference to FIG. 2, thermal processor 30 according to the present invention can be referred to as a flatbed-type processor wherein rollers 70, 72 and heat plates 78 of preheat chamber 34, and rollers 96, 98 and heat plates 104 are spaced adjacent to and along horizontal transport path 58.) Another type of thermal processor can be referred to as a drum-type processor which, as the name implies, employs a heated drum around which a photothermographic film is at least partially wrapped and heated during a developing process. An additional and unexpected benefit provided by thermal processor 30 in the development of gelatin-based photothermographic imaging film is an improvement in the film's "Dmin Gain" relative to such film developed using a drum-type thermal processor. Dmin Gain is a test to determine how well a film ages. More specifically, Dmin is a minimum density of an image after development as generally known to one skilled in the art.

Figure 2:
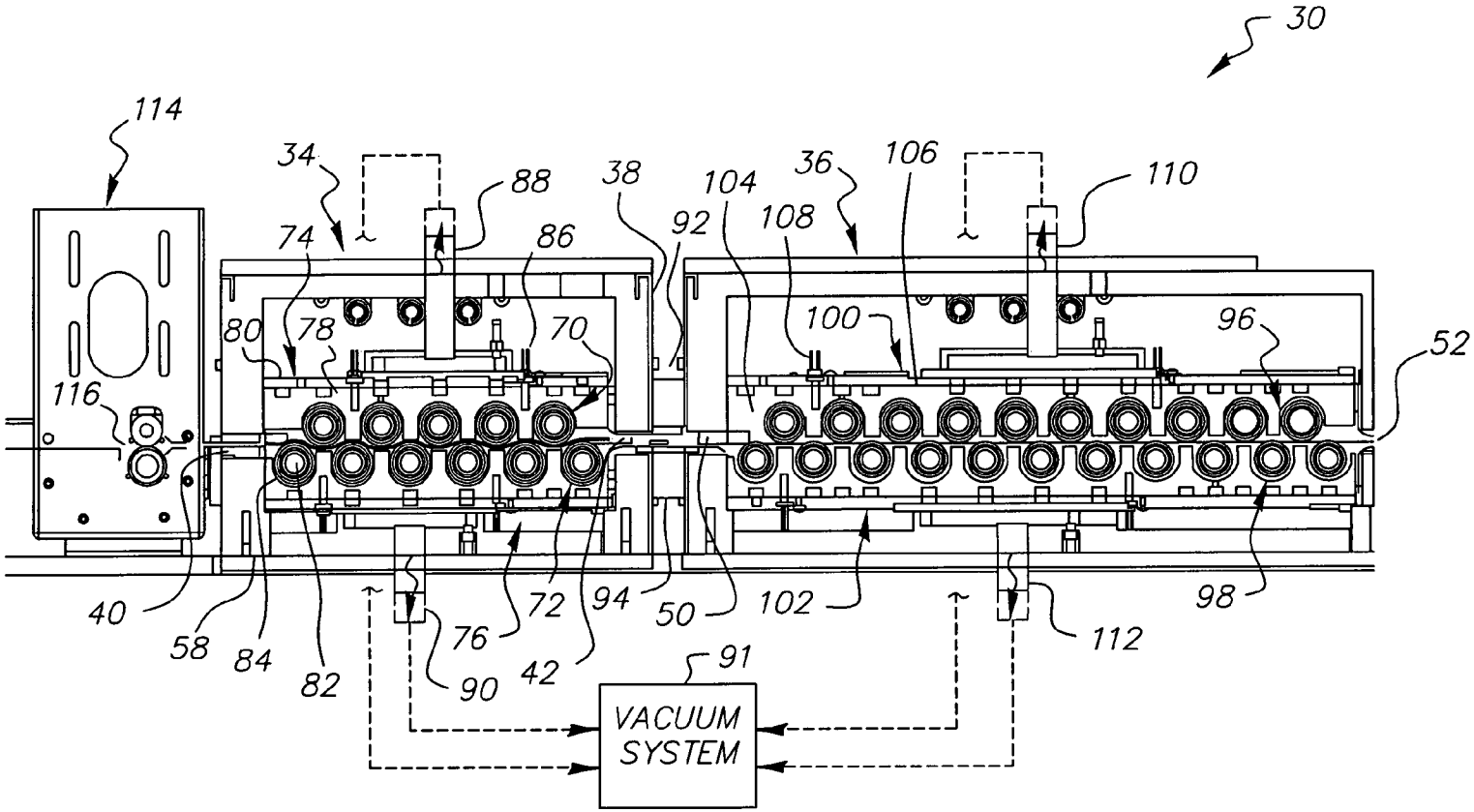
FIG. 2 is a block diagram illustrating one exemplary embodiment of a thermal processor according to the present invention.

FIG. 2 is a cross-sectional view illustrating one exemplary embodiment of thermal processor 30 according to the present invention, including preheat chamber 34 and dwell chamber 36. Transport system 44 includes a plurality of upper rollers 70 and a plurality of lower rollers 72. Heating system 46 includes an upper heating member 74 and a lower heating member 76, with each heating member including a heat plate 78 and a corresponding heat blanket 80.

Rollers 70 and 72 can include support shafts 82 having cylindrical sleeves of support material 84 surrounding the external surface of shafts 72. Support shafts 72 are rotatably mounted to opposite sides of enclosure 38 in a spaced relationship along transport path 58 between entrance 40 and exit 42, such that support material 74 contacts imaging material 32.

One or more of the rollers 70, 72 can be driven in order to drive imaging material 32 through preheat chamber 34 adjacent to the heating plates of heating members 74, 76 along transport path 58. In one preferred embodiment, all of the rollers 70, 72 are driven so that the surface of each roller is heated uniformly when no imaging material is contacting rollers 70, 72. In one embodiment, rollers 70, 72 are driven at a rotational speed such that imaging material 32 is maintained at a desired conditioning temperature for a desired conditioning period before exiting preheat chamber 34 at exit 42.

As illustrated, upper roller 70 can be positioned relative to lower rollers 72 to cause imaging material 32 to be bent or curved in an undulating fashion when transported between rollers 70, 72. Creating these curvatures can be accomplished, as shown, by horizontally offsetting upper rollers 70 from lower rollers 72 and vertically positioning them such that the upper rollers 70 and lower rollers 72 overlap a horizontal transport path 58. Curving imaging material 32 in this fashion increases a column stiffness of imaging material 32 and enables imaging material 32 to be transported through and heated to a conditioning temperature within preheat chamber 34 without a need for nip rollers or other pressure transporting means. Consequently, thermally-induced wrinkles of imaging material 32 associated with "nipping" or pressure can be minimized.

Upper rollers 70 can be sufficiently spaced apart, as can lower rollers 72, so that imaging material 32 can expand with minimal constraint in the direction generally perpendicular to transport path 58. This minimizes the potential for formation of significant wrinkles across imaging material, generally perpendicular to the direction of transport path 58. Furthermore, the minimization of these wrinkles can be accomplished without requiring that imaging material 32 be under tension when transported through preheat chamber 34. This is particularly important when developing imaging material 32 of relatively short lengths.

Heating system 46 includes an upper heating member 74 and a lower heating member 76. Heating members 74, 76 each include a heat plate 78 and, as illustrated, can be heated with a corresponding heat blanket 80. In one embodiment, heat plates 78 can be aluminum. Heat plates 78 associated with heating members 74, 76 can be configured with multiple zones with the temperature of each zone individually controlled, for example, by a controller (not shown) and a temperature sensor 86 corresponding to each zone, such as a resistance temperature device or a thermocouple.

Likewise, heat blankets 80 can be configured with multiple zones, with each zone corresponding to one of the heat plate zones and providing a temperature based on temperature sensor 86 of the corresponding heat plate zone. Additionally, the zones of heat blankets 80 can be configured with varying watt densities, such that one heat blanket zone may be capable of delivering more thermal energy to its corresponding heat plate zone relative to another heat blanket zone. Since different heat plate zones, depending upon their location within preheat chamber 34, may transfer more thermal energy to imaging material 32 than other heat plate zones, zonal control of heat blankets 80 is beneficial in maintaining imaging material 32 at an even temperature.

In one embodiment, as illustrated, heat plates 78 are shaped to partially wrap around a portion of the circumference of rollers 70, 72 such that rollers 70, 72. By partially nesting rollers 70, 72 within heat plates 78 in this fashion, heating members 74 and 76 can more effectively maintain the temperature of the outer surfaces of rollers 70, 72, resulting in their providing a more uniform heat transfer to imaging material 32.

By positioning heating members 74, 76 proximate to each side of transport path 58, each side of imaging material 32 is heated as it passes through preheat chamber 34. Furthermore, by providing zoned control of heat members 74, 76, the temperature across the surfaces of heat plates 78 can be more uniformly controlled and heat may be more evenly transferred to imaging material as it passes through preheat chamber 34. For example, if imaging material 32 has a width less than that of heat plates 78, the middle portions of heat plates 78 will transfer more heat to the imaging material and, thus, lose heat faster than the edge portions. In this instance, heat blankets 80 can be controlled so as to provide more heat to those zones corresponding to the central portions of heat plates 78.

As a result, water from the aqueous-based emulsion of imaging material 32 will be more evenly out-gassed from the surfaces of imaging material 32, thereby reducing the potential for visual artifacts in the developed image due to uneven moisture levels in the emulsion. Also, by transporting imaging material 32 through preheat chamber 34 on upper rollers 70 and lower rollers 72 proximate to, but without contacting heat plates 78, each side of imaging material 32 is able to freely outgas water vapor from the aqueous-based emulsion.

In one embodiment, as illustrated, preheat chamber 34 includes an evacuation system that includes exhaust ports 88 and 90 that are configured to couple to an external vacuum system 91. External vacuum system 91 is configured to draw air from preheat chamber 34 to thereby exhaust air and substantially all water vapor and other byproducts released from the aqueous-based emulsion of imaging material 32 from preheat chamber 34. In one embodiment, the exhaust air is filtered after removal from preheat chamber 34. In one embodiment, the evacuation system is configured such that external vacuum system 91 draws external air into preheat chamber 34 via entrance 40 and exit 42. Entrance 40 and exit 42 can be flow restricted or sealed, and the evacuation system configured to include passages or channels through heat plates 78 through which external vacuum system 91 draws external air so that the external air is heated prior to entering preheat chamber 34 to thereby better maintain the temperature of imaging material 32 at a desired conditioning temperature.

In one embodiment, as illustrated, thermal processor 30 includes a transition section 92 positioned between preheat chamber 34 and dwell chamber 36. Transition section 92 includes a guide channel 94 configured to guide imaging material 32 from exit 42 of preheat chamber 34 to entrance 50 of dwell chamber 36. In one embodiment, exit 42 of preheat chamber 34 and entrance 50 to dwell chamber 36 include seals to substantially maintain thermal isolation between preheat chamber 34 and dwell chamber 36.

As illustrated, dwell chamber 36 can be configured in a fashion similar to preheat chamber 34, with transport system 54 including a plurality of upper rollers 96 and a plurality of lower rollers 98. Likewise, heating system 56 includes an upper heating member 100 and a lower heating member 102, with each heating member including a heat plate 104 and a corresponding heating blanket 106. In one embodiment, dwell chamber 36 can be similar to the dwell chamber disclosed in U.S. Pat. No. 5,869,806, which is herein incorporated by reference.

One or more of the rollers 96, 98 can be driven so as to move imaging material 32 through dwell chamber 36 along transport path 58 adjacent to heating members 100, 102. In one embodiment, rollers 100, 102 are driven at a rotational speed such that imaging material 32 is heated from the conditioning temperature to the developing temperature and held at the developing temperature for a desired developing period as it is transported through dwell chamber 36 from entrance 50 to exit 52. In one preferred embodiment, the rotational speed of rollers 96, 98 of dwell chamber 36 substantially match the rotational speed of rollers 70, 72 of preheat chamber 34.

Heating members 100, 102 can be zoned in a fashion similar to that of heating members 74, 76 of preheat chamber 34, with the temperature of each zone being individually controlled based on a temperature sensor 108 corresponding to each zone. By zoning heating members 100, 102, heat can be more uniformly transferred to imaging material 32. For instance, zones adjacent to entrance 50 lose heat to imaging material 32 more quickly than zones adjacent to exit 52. Therefore, those zones adjacent to entrance 50 can be controlled so as to provide more heat than those zones adjacent to exit 52.

In one embodiment, as illustrated, dwell chamber 36 includes an evacuation system that includes exhaust ports 110 and 112 that are configured to couple to external vacuum system 91. External vacuum system is configured to draw air from dwell chamber 36 through exhaust ports 110 and 112 in order to exhaust gaseous byproducts released by imaging material 32 during development. In one embodiment, the exhaust air is filtered after removal from preheat chamber 34. In one embodiment, the evacuation system is configured such that the external vacuum system 91 draws external air into dwell chamber 36 via entrance 50 and exit 52. Entrance 50 and exit 52 can be flow restricted or sealed, and the evacuation system configured to include passages or channels through heat plates 104 through which external vacuum system 91 draws external air is so that the external air is heated prior to entering dwell chamber 36 to thereby better maintain the temperature of imaging material 32 at a desired conditioning temperature.

In one embodiment, thermal processor 30 includes a receiver section 114. Receiver section 114 includes a pair of nip rollers 116 configured to receive imaging material 32 at an ambient temperature and to feed imaging material to transport system 44 of preheat chamber 34 via entrance 40.

Figure 3:
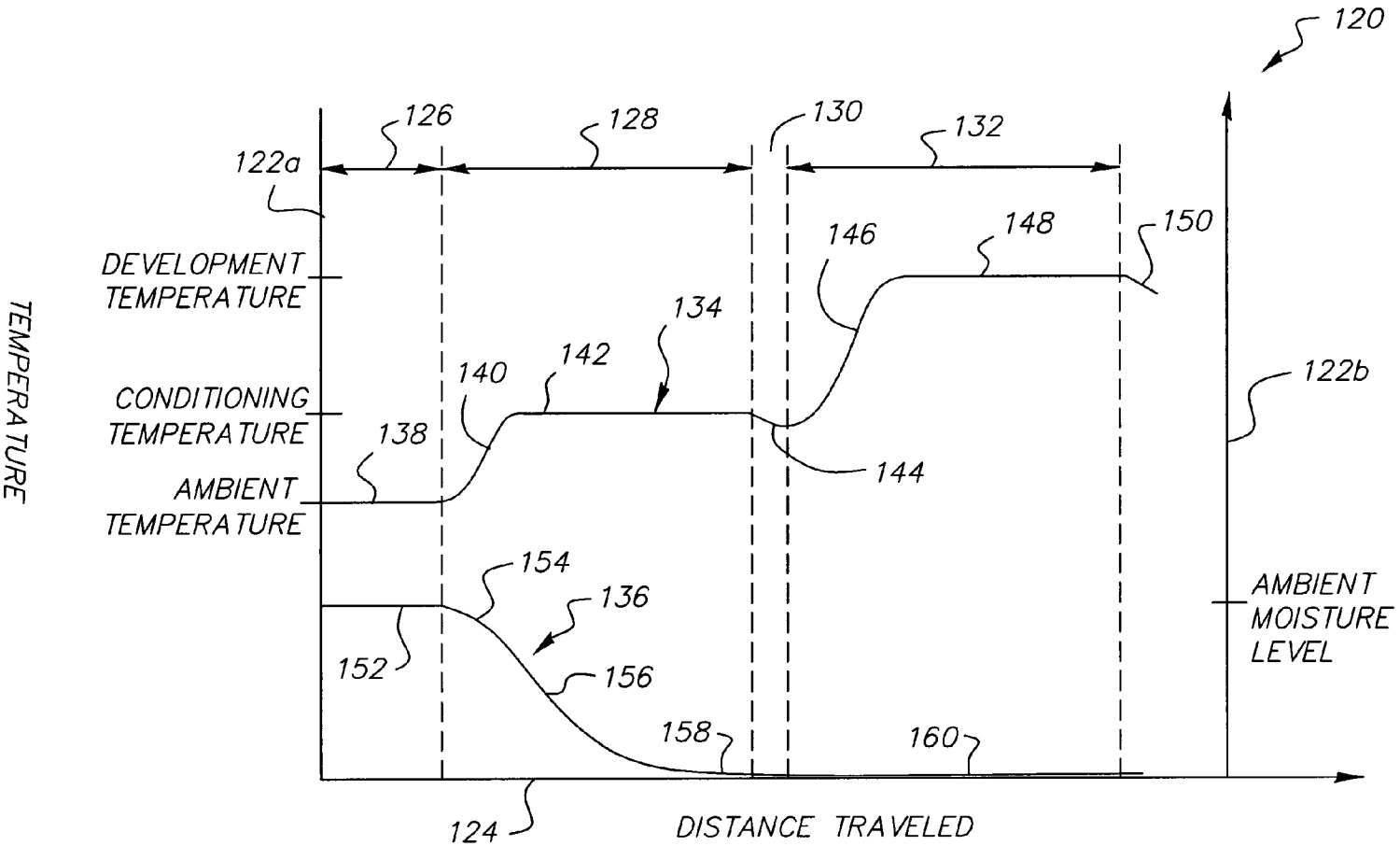
FIG. 3 is a graph illustrating temperature and moisture levels of a suitable gelatin-based photothermographic film during processing by the thermal processor of FIG. 2.

FIG. 3 is a graph 120 illustrating the temperature and moisture levels of gelatin-based imaging material 32 as it travels through thermal processor 30 as illustrated by FIG. 2. Temperature and moisture levels are illustrated along the y-axis, as indicated respectively at 122*a* and 122*b*, and a distance traveled through thermal processor 30 is illustrated along the x-axis as indicated at 124. Graph 120 includes zones representative of the sections/chambers of thermal processor 30, with a zone 126 representative of receiver section 114, a zone 128 representative of preheat chamber 34, a zone 130 representative of transition section 92, and a zone 132 representative of dwell chamber 36. Waveforms 134 and 136 respectively represent the temperature and moisture level of imaging material 32.

As imaging material 32 enters receiver section 114, it is at an ambient temperature level as indicated at 138. After entering preheat chamber 34, the temperature of imaging material begins to rise, as indicated at 140, until the temperature of the imaging material reaches the desired conditioning temperature, as indicated at 142. The temperature of imaging material 32 is maintained at the desired conditioning temperature by preheat chamber 34 until it enters transition section 92, where the temperature may drop slightly as indicated at 144. After entering dwell chamber 36, the temperature of imaging material 32 rises, as indicated at 146, until the temperature reaches the desired developing temperature, as indicated at 148. Dwell chamber 36 maintains the temperature of imaging material 32 at the desired developing temperature until imaging material exits the dwell chamber 36, as indicated at 150.

As illustrated by waveform 136, imaging material 32 has an arbitrary moisture level as it enters and travels through receiver section 114, as indicated at 152. As imaging material 32 enters preheat chamber 34 and the its temperature begins to rise, its moisture level begins to drop, as indicated at 154. As the temperature of imaging material 32 rises to the desired conditioning temperature at 142, the removal of moisture from the aqueous-based emulsion accelerates, as indicated at 156, until the moisture level drops to substantially zero, as indicated at 158. The moisture level remains at near-zero levels as it travels through transition section 92 and dwell chamber 36, as indicated at 160.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A preheat chamber for conditioning an exposed imaging material having a conditioning threshold temperature and a development temperature higher than said conditioning threshold temperature, the preheat chamber comprising:

a chamber housing having an entrance and an exit;

a transport system for moving exposed imaging material through said chamber housing between said entrance and said exit;

a heating system configured to heat the exposed imaging material to a desired conditioning temperature above the conditioning threshold temperature and below the development temperature as the imaging material is moved through the chamber housing;

wherein the imaging material includes an aqueous-based emulsion of heat sensitive materials in an aqueous-based solvent, wherein the desired conditioning temperature causes moisture to be released from the aqueous-based emulsion and wherein the preheat chamber maintains the imaging material at the desired conditioning temperature for a required time period to cause substantially all moisture to be released from the aqueous-based emulsion before it is developed; and an evacuation system for removing from said chamber housing substantially all water vapor and other byproducts released from the aqueous based emulsion.

2. The preheat chamber of claim 1, wherein the desired conditioning temperature is within a conditioning temperature range.

3. The preheat chamber of claim 2, wherein the desired conditioning temperature ranges from 110 degrees centigrade to 130 degrees centigrade.

4. The preheat chamber of claim 2, wherein an upper temperature level of the temperature range at a margin below the development temperature to ensure that development does not occur, and a lower temperature level at a margin above the conditioning threshold temperature.

5. The preheat chamber of claim 1, wherein the desired conditioning temperature is substantially equal to 110 degrees centigrade.

6. The preheat chamber of claim 1, wherein said transport system is configured to move the imaging material through the chamber housing along a transport path proximate to the heating system.

7. The preheat chamber of claim 6, wherein the transport system receives the imaging material at an ambient temperature at the entrance and, after moving the imaging material through the preheat chamber along the transport path, provides the imaging material at the exit substantially at the conditioning temperature and with substantially all of the moisture released from the emulsion.

8. The preheat chamber of claim 7, wherein the transport system moves the imaging material through the preheat chamber at a rate such that the imaging material is maintained at the desired conditioning temperature for the required time period.

9. The preheat chamber of claim 1, wherein the imaging material is coated on a first and a second major surface with the emulsion, and wherein the heating system is configured to heat the first and second major surfaces to a temperature substantially equal to the desired conditioning temperature.

10. The preheat chamber of claim of claim 9, wherein the heating system includes a plurality of zones, wherein a temperature of each zone is individually controllable.

11. A thermal processor for thermally developing an image in an imaging material having a conditioning threshold temperature and a developing threshold temperature higher than said conditioning threshold temperature, the thermal processor comprising:

a preheat chamber configured to receive the imaging material at an ambient temperature and to heat the imaging material to a desired conditioning temperature at least equal to the conditioning threshold temperature but less than the development threshold temperature; and a dwell chamber thermally isolated from said preheat chamber configured to receive the imaging material at the conditioning temperature and to heat the imaging material to a desired developing temperature at least equal to the developing threshold temperature.

12. The thermal processor of claim 11, wherein an incremental difference between the desired conditioning temperature and the desired developing temperature does not exceed a predetermined amount.

13. The thermal processor claim 12, wherein the predetermined amount is 40 degrees centigrade.

14. The thermal processor of claim 11, wherein the dwell chamber is configured to maintain the imaging material at the desired developing temperature for a time period resulting in substantially optimal development of the image.

15. The thermal processor of claim 11, wherein the dwell chamber is thermally isolated from the preheat chamber.

16. The thermal processor of claim 11, wherein the preheat chamber further comprises:

a heating system configured to heat the imaging material to the desired conditioning temperature; and a transport system configured to move the imaging material through the preheat chamber.

17. The thermal processor of claim 16, wherein the dwell chamber further comprises:

a heating system configured to heat the imaging material from the desired conditioning temperature to the desired developing temperature; and a transport system configured to move the imaging material through the preheat chamber.

18. The thermal processor of claim 17, wherein the imaging material is coated with an aqueous-based emulsion having a moisture level, wherein preheat chamber heating system heats said imaging material to a temperature at least equal to the conditioning threshold temperature causes moisture to be released from the emulsion, and wherein said dwell chamber heating system heats said imaging material to a temperature at least equal to the development threshold temperature causes the image to develop.

19. The thermal processor of claim 18, wherein the preheat chamber is configured to maintain the imaging material at the conditioning temperature for a time period necessary to cause substantially all of the moisture to be released from the emulsion and including an evacuation system for removing substantially all of the released moisture vapor from said preheat chamber.

20. The thermal processor of claim 19, wherein the preheat chamber transport system moves the imaging material through the preheat chamber at a rate such that imaging material is maintained at the desired conditioning temperature for the time period necessary to cause substantially all of the moisture to be released from the emulsion.

21. The thermal processor of claim 20, wherein the dwell chamber transport system moves that imaging material through the dwell chamber at a rate substantially equal to the rate at which the preheat chamber transport system moves the imaging material through the preheat chamber.

22. A preheat chamber for preconditioning a thermally processable exposed imaging material for development, the exposed imaging material having a first and a second major surface and coated on at least one of the major surfaces with a moisture-sensitive aqueous-based emulsion, the preheat chamber comprising:

a heating system configured to heat the thermally processable exposed imaging material to a desired temperature within a temperature range high enough to cause substantially all moisture to be released from the aqueous-based emulsion but below a development temperature of the imaging material;

an evacuation system configured to couple to an external vacuum system to remove the released moisture from the preheat chamber; and a transport system that moves the imaging material through the preheat chamber along a transport path.

23. The preheat chamber of claim 22, wherein the desired temperature is within a temperature range.

24. The preheat chamber of claim 22, wherein the desired temperature is substantially equal to 110 degrees centigrade.

25. The preheat chamber of claim 22, wherein the heating system comprises:

a first heating member positioned along the transport path so as to be proximate to the first major surface of the imaging material; and a second heating member positioned along the transport path so as to be proximate to the second major surface of the imaging material.

26. The preheat chamber of claim 25, wherein the first and second heating members each comprise a plurality of individually controllable zones that can each be heated to a different temperature level.

27. The preheat chamber of claim 26, wherein each zone has a corresponding sensing device to monitor the temperature level of the zone.

28. The preheat chamber of claim 25, wherein the first and second heating members each comprise:

a heat plate having a first major surface proximate to the imaging material and a second major surface; and a blanket heater bonded to the second major surface.

29. The preheat chamber of claim 28, wherein the heat plate is aluminum.

30. The preheat chamber of claim 22, wherein the conveyance system comprises:

a first plurality of rotatable members positioned along the transport path so as to contact the first major surface of the imaging material; and a second plurality of rotatable member positioned along the transport path so as to contact the second major surface of the imaging material.

31. The preheat chamber of claim 30, wherein at least one of the first plurality of rotatable members is driven in a first direction and at least one of the second plurality of rotatable members is driven in direction opposite the first direction such that contact with the imaging material moves the imaging material along the transport path.

32. The preheat chamber of claim 30, wherein each of the rotatable members comprises a roller having a cylindrical shaft covered with a support material.

33. The preheat chamber of claim 32, wherein the cylindrical shafts are aluminum.

34. The preheat chamber of claim 22, further comprising:

an enclosure encompassing the heating system and the conveyance system, wherein the enclosure and heating system form an oven enclosing the conveyance system, wherein the enclosure has an entrance to the oven and an exit from the oven, and wherein the conveyance system moves the imaging material through the oven along the transport path from the oven entrance to the oven exit.

35. The preheat chamber of claim 34, wherein the evacuation system includes at least one exhaust port extending through the enclosure and configured to couple to the external vacuum system such that the external vacuum system draws air from the oven through the at least one exhaust port to thereby exhaust air and substantially all of the released moisture from the oven via the at least one exhaust port.

36. The preheat chamber of claim 35 wherein the evacuation system further includes an air flow path through the heating system such that the external vacuum system draws external air through the heating system and into the oven, such that the external air is heated to a temperature substantially equal to a temperature of the oven before entering the oven.

37. A method of thermally processing an exposed imaging material having a conditioning threshold temperature and a development threshold temperature higher than said conditioning threshold temperature, the method comprising:

first heating the exposed imaging material to a conditioning temperature at least equal to the conditioning threshold temperature but less than the development threshold temperature; and maintaining the imaging material at the conditioning temperature for a time period.

38. The method of claim 37, further comprising:

second heating the exposed imaging material from the conditioning temperature to a developing temperature at least equal to the development threshold temperature wherein said second heating is thermally isolated from said first heating; and maintaining the imaging material at the developing temperature for a time period to develop the image in said exposed imaging material.

39. A thermal processor for thermally developing an image in an exposed imaging material having a conditioning temperature range and a developing temperature range higher than said conditioning temperature range, the thermal processor comprising:

means for heating the exposed imaging material from a given ambient temperature to a desired conditioning temperature that is at least within the conditioning temperature range but less than a temperature within the developing temperature range so as not to develop said image in said exposed imaging material.

40. The thermal processor of claim 39, wherein the imaging material includes a moisture-sensitive aqueous-based emulsion including heat sensitive materials in an aqueous-based solvent, and wherein the desired conditioning temperature range causes moisture to be released from the emulsion, the thermal processor further comprising:

means for maintaining the imaging material at the desired conditioning temperature for a time period necessary to cause substantially all moisture to be released from the emulsion; and means for evacuating said moisture from the environment around said imaging material.

41. The thermal processor of claim 40, further comprising:

means for heating the imaging material from the desired conditioning temperature to a desired developing temperature, wherein the desired developing temperature is within the developing temperature range.

42. The thermal processor of claim 41, further comprising:

means for maintaining the imaging material at the desired developing temperature for a time period resulting in substantially optimal thermal development of the image.

43. A method of developing a gelatin based photothermographic imaging material comprising:

providing an exposed photothermographic imaging material including a base material coated on each side with an aqueous based emulsion of heat sensitive materials including developers in an aqueous based solvent;

heating said exposed photothermographic imaging material in an enclosed preheat chamber to a temperature within a conditioning temperature range, but below a development temperature range to release fluid, consisting primarily of water, in the form of vapor from the emulsion for a period so that substantially all of the fluid including water is released from the emulsion; and evacuating said vapor from said preheat chamber.

44. The method of claim 43 including developing said exposed photothermographic imaging material in a dwell chamber thermally isolated from said preheat chamber at a development temperature within a development temperature range that is higher than said conditioning temperature range for a development period that will provide substantially optimal development of the exposed image in said imaging material.

* * * * *